United States Patent [19]

Hundertmark

[11] Patent Number: 4,589,378

[45] Date of Patent: May 20, 1986

[54] PRESSURE-VACUUM AIDED VALVE

[75] Inventor: James M. Hundertmark, Fond du Lac, Wis.

[73] Assignee: Brunswick Corp., Skokie, Ill.

[21] Appl. No.: 689,914

[22] Filed: Jan. 9, 1985

[51] Int. Cl.[4] ..... F01P 7/14

[52] U.S. Cl. ..... 123/41.02; 123/41.08; 123/41.13

[58] Field of Search ..... 123/41.01, 41.02, 41.08, 123/41.13, 41.44; 440/88

[56] References Cited

U.S. PATENT DOCUMENTS

| | | | |
|---|---|---|---|
| 2,478,489 | 8/1949 | Kelson, Sr. | 123/41.08 |
| 3,521,610 | 7/1970 | Coudriet | 123/41.08 |
| 4,082,068 | 4/1978 | Hale | 123/41.02 |
| 4,457,727 | 7/1984 | Flaig | 123/41.13 |

FOREIGN PATENT DOCUMENTS

| | | | |
|---|---|---|---|
| 58-30413 | 2/1983 | Japan | 123/41.08 |

OTHER PUBLICATIONS

Johnson 275 3.6GT VRO Brochure, 1984.

*Primary Examiner*—William A. Cuchlinski, Jr.
*Attorney, Agent, or Firm*—Andrus, Sceales, Starke & Sawall

[57] ABSTRACT

In a two cycle internal combustion engine having a water cooling system with a water valve (4) spring biased (64) to a normally closed condition and opened by water pressure in the engine block (14) to permit passage of water out of the block to a radiator or the like for increased cooling, an improvement is provided for keeping the water valve closed at idle without increased spring pressure such that the water valve remains closed at idle, notwithstanding block pressure, and thus enables the engine to warm up, and such that the water valve opens at higher engine speeds to afford proper cooling and prevent abnormally high water pressure in the block which would otherwise be caused by increased spring pressure. Engine crankcase pressure (6) is continually provided (24) to the valve to aid spring biased closing thereof. Engine manifold vacuum (16) is supplied (28) selectively through a throttle controlled valve (30) to vent and relieve crankcase pressure at the valve and to aid opening of the valve against the spring.

10 Claims, 1 Drawing Figure

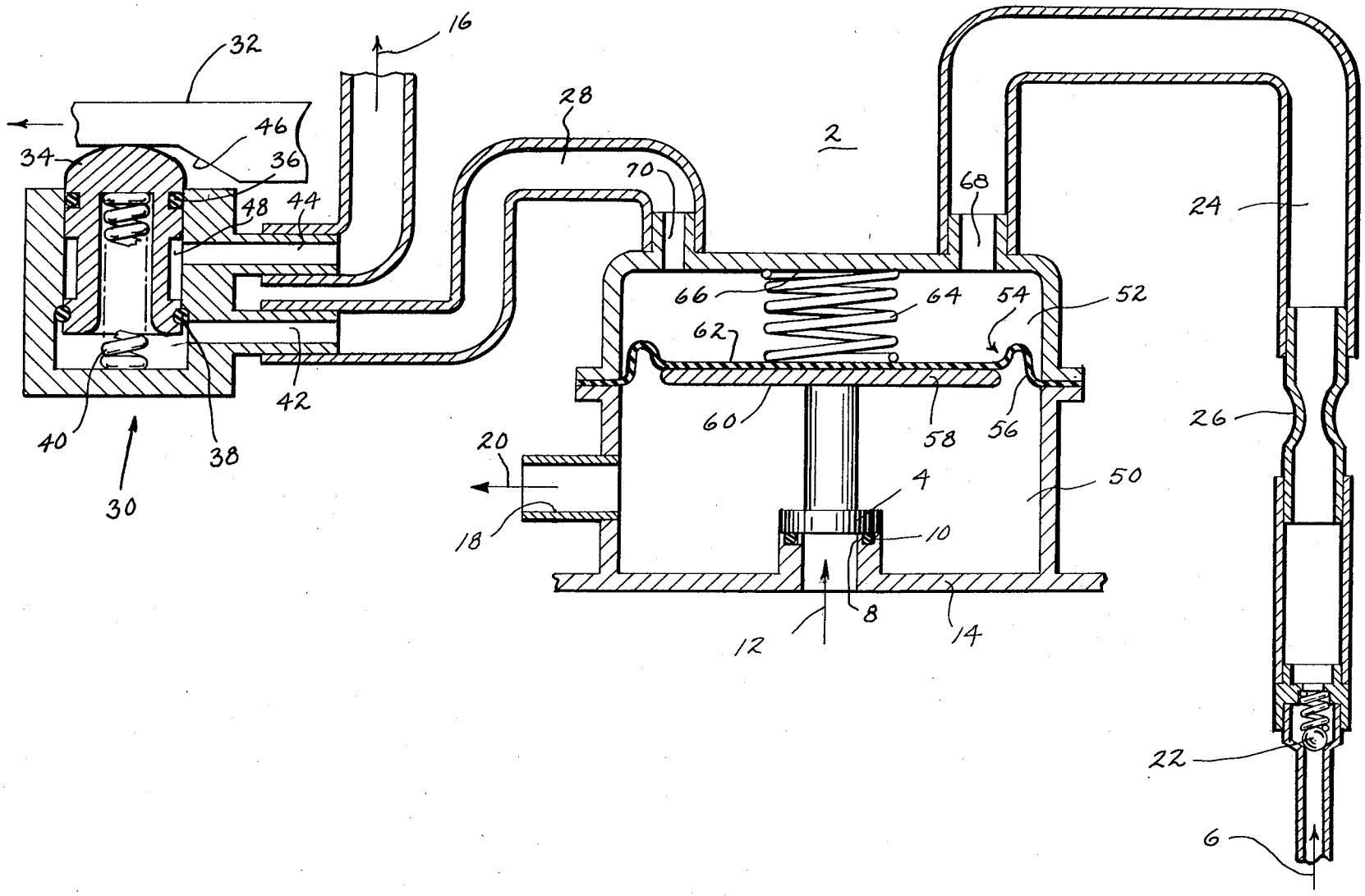
2
4
6
8
10
12
14
16
18
20
22
24
26
28
30
32
34
36
38
40
42
44
46
48
50
52
54
56
58
60
62
64
66
68
70

PRESSURE-VACUUM AIDED VALVE

BACKGROUND AND SUMMARY

In a water cooled two cycle internal combustion engine, it is known to provide a bypass water valve which is closed at low or idle speeds of the engine to restrict the flow of water or coolant within the engine block and enable the engine to warm up. The water valve is typically spring biased to a normally closed condition. At higher engine speeds, the water pressure in the engine block overcomes the spring bias and opens the valve to enable the water to flow to another part of the cooling system such as a radiator.

Problems have been encountered at low engine speeds where the water pressure in the engine block may be high enough to overcome the valve spring force and thus open the valve and force water therethrough. This is undesirable because it does not allow the engine to warm up. The engine may not get hot enough, and hence the engine does not idle well and may require a richer fuel mixture which in turn creates more smoke. A higher spring pressure on the valve is not an acceptable solution because this would not allow the valve to open early enough at higher engine speeds, which in turn would cause the water pressure to be too high at the higher engine speeds and also would not afford the increased cooling necessary at the higher speeds.

The present invention addresses and solves the above noted problem without increased spring pressure and without complicated mechanical linkage.

BRIEF DESCRIPTION OF THE DRAWING

The sole drawing FIGURE schematically illustrates a pressure-vacuum aided valve in accordance with the invention.

DETAILED DESCRIPTION

The sole drawing FIGURE shows a pressure-vacuum aided water valve 2 in accordance with the invention in a cooling system in a two cycle internal combustion engine such as shown in Hale U.S. Pat. No. 4,082,068, incorporated herein. A bypass water poppet valve 4 is operated by engine crankcase pressure 6 to a closed condition seated against input port 8, sealed against O-ring 10, preventing discharge of water 12 from the engine block 14, thus enabling the engine to warm up. The valve is operated by engine manifold vacuum at 16 to an open condition wherein poppet valve 4 is spaced above input port 8 and O-ring 10, permitting discharge of water 12 from engine block 14 through input port 8 past raised valve 4 to output port 18 at discharge flow path 20 to another part of the cooling system such as a radiator.

Crankcase pressure at 6 is supplied through one-way valve 22 through passage 24, including restriction 26, to the water valve. Manifold vacuum at 16 is selectively provided to the water valve along passage 28 through a normally closed valve 30 which is controlled by throttle linkage 32. Valve 30 is known in the art and will be only briefly described. Throttle controlled valve 30 has a button or plunger 34 carrying sealing O-rings 36 and 38 and biased upwardly by spring 40 to the normally closed position blocking communication between passages 28 and 16 at respective ports 42 and 44. Leftward movement of throttle linkage 32 depresses plunger 34 downwardly due to camming surface 46 which actuates valve 30 to an open condition providing communication between ports 42 and 44 through passage 48. In its open condition, valve 30 vents and relieves crankcase pressure from the water valve and applies manifold vacuum to the water valve through passage 28. In the closed condition, valve 30 blocks venting of crankcase pressure from the water valve and blocks application of manifold vacuum to the water valve. Valve 30 is normally closed at idle, and opened at higher engine speed.

The water valve has a first chamber 50 with input port 8 from engine block 14 for receiving water at 12, and with output port 18 for discharging same at 20 to the cooling system. The water valve has a second chamber 52 separated and isolated from first chamber 50 by a movable diphragm 54, which may include a flexible rubber disc-like bellows member 56 and a rigid plate member 58. Diaphragm 54 has a first side 60 facing first chamber 50 and having valve member 4 extending from first side 60 into first chamber 50 to seat against and close input port 8 in a first downward position of diaphragm 54. Poppet valve member 4 opens input port 8 in a second upward position of diaphragm 54. Diaphragm 54 has a second side 62 facing second chamber 52, and a spring 64 is biased between second side 62 of the diaphragm and a stop 66 in second chamber 52. In the preferred species, a first dedicated pressure port 68 communicates with pressure passage 24, and a second dedicated vacuum port 70 communicates with vacuum passage 28.

Spring biased water bypass poppet valve 4 is known in the art. Valve 4 is spring biased to a normally closed condition, and is opened by water pressure in engine block 14 to permit passage of water at 12 out of the block for increased cooling. In the present invention, an improvement is provided for keeping the water valve closed at idle without increased spring pressure at 64 such that the water valve remains closed at idle, notwithstanding block pressure, and thus enables the engine to warm up, and such that the water valve opens at higher engine speeds to afford proper cooling and prevent abnormally high water pressure in engine block 14 which would otherwise be caused by increased spring pressure at 64.

In accordance with the present invention, means are provided supplying a pressure differential from the engine to the water valve to aid spring biased operation of the latter and including means responsive to engine speed to vary the pressure differential and to reduce valve closing force with increasing engine speed. Engine crankcase pressure is preferably continually supplied through passage 24 to chamber 52 of the water valve to aid spring biased closing of the valve. Engine manifold vacuum is preferably selectively supplied through passage 28 to chamber 52 through throttle controlled valve 30 to aid opening of the water valve against spring 64. Throttle controlled valve 30 provides means responsive to engine speed to vary the pressure differential supplied to the valve and to reduce valve closing force with increasing engine speed.

Normally closed valve 30 is in the vacuum passage 28 and is controlled by engine throttle linkage 32 between the closed condition shown in the drawing at idle, and an open condition at higher engine speed. In the normally closed condition at idle, valve 30 blocks application of vacuum to the water valve in chamber 52 such that engine crankcase pressure in passage 24 aids spring biased downward closing of poppet valve member 4. At higher engine speeds, linkage 32 opens the normally closed valve 30 and enables application of manifold vacuum to the water valve in chamber 52 to vent and relieve crankcase pressure from chamber 52 and reduce downward closing force on poppet member 4 and aid opening thereof. Constriction 26 in pressure passage 24 relative to vacuum passage 28 ensures that no net crankcase pressure is applied to the water valve in chamber 52 when valve 30 is open.

A desirable feature of the invention is that it can be used with existing poppet valve structure without having to increase the size of the valve or otherwise redesign the valve to a greater lateral surface area to accommodate the pressure necessary to operate the valve. The preferred species uses existing parts, eliminating the need for redesign or modification, and thus is cost effective. In the present design, the valve closing force provided by spring 64 is aided, not replaced, by pressure differential. To close the valve with pressure differential only, without the aid of spring 64, would require larger lateral surface area, and hence a redesign of exisiting poppet valve structure, which is undesirable in accordance with the preferred species of the present invention. In other species, a redesign or the use of nonconventional poppet valve structure may be acceptable.

It is recognized that various modifications and alternatives are possible within the scope of the appended claims.

I claim:

1. In a two cycle internal combustion engine having a water or the like cooling system, a water valve operated by engine crankcase pressure to a closed condition preventing discharge of water from the engine block, thus enabling the engine to warm up, and operated by engine manifold vacuum to an open condition permitting discharge of water from the engine block for increased cooling, wherein said crankcase pressure is continually provided to said water valve, and wherein manifold vacuum is selectively provided to said water valve through a throttle controlled valve.

2. The invention according to claim 1 wherein said throttle controlled valve has an open condition venting and relieving crankcase pressure from said water valve and applying manifold vacuum to said water valve, and has a closed condition blocking venting of crankcase pressure from said water valve and blocking application of manifold vacuum to said water valve.

3. The invention according to claim 2 wherein said throttle controlled valve comprises a normally closed valve closed at idle and opened at higher engine speed.

4. In a two cycle internal combustion engine having a water or the like cooling system with a water valve spring biased to a normally closed condition and opened by water pressure in the engine block to permit passage of water out of the block for increased cooling, an improvement for keeping said water valve closed at idle without increased spring pressure such that said water valve remains closed at idle, notwithstanding block pressure, and thus enables the engine to warm up, and such that said water valve opens at higher engine speeds to afford proper cooling and prevent abnormally high water pressure in said block which would otherwise be caused by increased spring pressure, said improvement comprising means supplying a pressure differential from said engine to said water valve to aid spring biased operation of the latter and including means responsive to engine speed to vary said pressure differential and to reduce valve closing force with increasing engine speed.

5. The invention according to claim 4 wherein said supplying means comprises pressure supply means for supplying engine crankcase pressure to said water valve to aid said spring biased closing thereof.

6. The invention according to claim 4 wherein said supplying means comprises vacuum supply means for supplying engine manifold vacuum to said water valve to aid opening thereof against said spring.

7. The invention according to claim 4 wherein:

said supplying means comprises pressure supply means for supplying engine crankcase pressure to said water valve to aid said spring biased closing thereof, and comprises vacuum supply means for supplying engine manifold vacuum to said water valve to aid opening thereof against said spring; and said means responsive to engine speed comprises a normally closed throttle controlled valve in said vacuum supply means and controlled by engine throttle linkage between a closed condition at idle and an open condition at higher engine speed, such that said throttle controlled valve when normally closed at idle blocks application of vacuum to said water valve such that said crankcase pressure in said pressure supply means aids spring biased closing of said water valve, and such that said throttle controlled valve when opened at higher engine speed enables application of manifold vacuum to said water valve to vent and relieve said crankcase pressure from said water valve and hence reduce closing force on said water valve and aid opening thereof.

8. The invention according to claim 7 wherein each of said pressure and vacuum supply means comprises a respective passage, and comprising constriction means in said pressure passage relative to said vacuum passage ensuring that no net crankcase pressure is applied to said water valve when said throttle controlled valve is open.

9. The invention according to claim 7 wherein said water valve has a first chamber with an input port from the engine block for receiving water and an output port for discharging water to said cooling system, and a second chamber separated and isolated from said first chamber by a movable diaphragm, said diaphragm having a first side facing said first chamber and a valve member extending from said first side into said first chamber to seat against and close said input port in a first position of said diaphragm and opening said input port in a second position of said diaphragm, said diaphragm having a second side facing said second chamber and a spring biased between said second side of said diaphragm and a stop in said second chamber, and port means in said second chamber communicating with said supply means.

10. The invention according to claim 9 wherein said last mentioned port means comprises a first dedicated pressure port communicating with said pressure passage, and a second dedicated vacuum port communicating with said vacuum passage.

* * * * *